US007085523B2

(12) United States Patent
Fujita et al.

(10) Patent No.: US 7,085,523 B2
(45) Date of Patent: Aug. 1, 2006

(54) IMAGE FORMING APPARATUS HAVING A MEDIUM TRANSPORTING BELT FORMED IN AN ENDLESS SHAPE

(75) Inventors: Shigeo Fujita, Nagano (JP); Toshihiko Yamazaki, Nagano (JP); Hiroshi Ito, Nagano (JP); Shinichi Kamoshida, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 196 days.

(21) Appl. No.: 10/705,236

(22) Filed: Nov. 12, 2003

(65) Prior Publication Data

US 2004/0190950 A1 Sep. 30, 2004

(30) Foreign Application Priority Data

| | | |
|---|---|---|
| Nov. 11, 2002 | (JP) | P2002-326522 |
| Nov. 11, 2002 | (JP) | P2002-326523 |
| Nov. 11, 2002 | (JP) | P2002-326526 |
| Dec. 18, 2002 | (JP) | P2002-366089 |
| Jan. 27, 2003 | (JP) | P2003-017814 |
| Jan. 27, 2003 | (JP) | P2003-017815 |
| Jan. 27, 2003 | (JP) | P2003-017816 |
| Jan. 27, 2003 | (JP) | P2003-017817 |

(51) Int. Cl.
*G03G 15/01* (2006.01)

(52) U.S. Cl. ..... 399/302; 399/303; 399/313

(58) Field of Classification Search ..... None
See application file for complete search history.

(56) References Cited

U.S. PATENT DOCUMENTS

| | | | | |
|---|---|---|---|---|
| 5,455,136 | A * | 10/1995 | Yu et al. | 430/58.65 |
| 5,714,290 | A * | 2/1998 | Yu et al. | 430/56 |
| 5,966,572 | A * | 10/1999 | Mishra et al. | 399/160 |
| 6,042,917 | A * | 3/2000 | Schlueter et al. | 428/60 |
| 6,197,461 | B1 * | 3/2001 | Foltz et al. | 430/56 |
| 6,405,006 | B1 * | 6/2002 | Tabuchi | 399/162 |

FOREIGN PATENT DOCUMENTS

| | | | |
|---|---|---|---|
| JP | 54110845 | A * | 8/1979 |
| JP | 8-305112 | A | 11/1996 |
| JP | 9-146386 | A | 6/1997 |
| JP | 10-221967 | A | 8/1998 |
| JP | 11-184203 | A | 7/1999 |
| JP | 11288179 | A * | 10/1999 |
| JP | 3025070 | B2 | 1/2000 |
| JP | 2001-343864 | A | 12/2001 |
| JP | 2002-91107 | A | 3/2002 |

* cited by examiner

*Primary Examiner*—Robert Beatty
(74) *Attorney, Agent, or Firm*—Sughrue Mion, PLC

(57) ABSTRACT

A belt member is seamed to form an endless belt which is stretched by a plurality of roller members and circulated in a first direction. The belt member is provided with an electrode portion at a first end portion thereof in a second direction perpendicular to the first direction. A cleaning member is abutted against the belt member. A seam of the belt member extends obliquely relative to the first direction such that an end of the seam confronting the electrode portion is situated in an upstream side of the first direction.

5 Claims, 15 Drawing Sheets

IMAGE FORMING APPARATUS HAVING A MEDIUM TRANSPORTING BELT FORMED IN AN ENDLESS SHAPE

BACKGROUND OF THE INVENTION

The present invention relates to an image forming apparatus having an image carrier belt or a medium transporting belt formed in an endless shape.

The present invention also relates to an image forming apparatus capable of controlling a stop position of an image carrier belt provided with a position indicator.

The present invention also relates to an image forming apparatus having a cleaning member or a secondary transferring member which is brought into contact with and separated from an intermediate transferring member.

In an intermediate transfer method of an electrophotography process in which a plurality of color images are laminated on an intermediate transfer member, an endless belt member suspended by a plurality of rollers is used as the intermediate transfer member. Alternatively, the endless belt member may be used as a photoconductive member or a transporting member for a recording medium.

Japanese Patent Publication No. 8-305112A discloses an endless intermediate transfer belt in which a seam is extended obliquely relative to the circulating direction thereof, in order to suppress the circulating speed fluctuation or vibration occurred when a step at the seam passes a roller such as a driving roller suspending the belt, so that to suppress nonuniformity of a final image.

On the other hand, Japanese Patent Publication No. 9-146386A discloses a similar endless intermediate transfer belt, in order to prevent the seam from bounding when it passes a cleaning blade to enhance the cleaning ability. Further this publication teaches that a reinforcement for the seam is adhered on the belt so as to extend obliquely relative to the circulating direction of the belt, in order to suppress the circulating speed fluctuation due to the seam.

However, these publications does not consider the extending direction of the oblique seam.

In a case where a cleaning blade is brought into contact with the surface of the intermediate transfer belt having an electrode layer at one widthwise end thereof, through which a bias voltage is applied to primarily transfer a toner image formed on a photoconductive member, if the seam is extended obliquely as described the above, forces act on toner scraped by the cleaning blade so as to convey toward the downstream side of the belt circulating direction along the seam. Therefore, in a case where the oblique seam is extended such that an end of the seam confronting the electrode layer is situated in the downstream side, the toner conveyed along the seam contaminate the electrode layer so that the transfer failure would be occurred.

In this specification, "the upstream side of the belt circulating direction" is defined as a side of which is first brought into contact with another contact member such as the cleaning blade, while "the downstream side of the belt circulating direction" is defined as a side of which is brought into contact with the contact member later. That is, in the case of FIG. 2, the upstream side is an upper side of the figure, whereas the downstream side is a lower side of the figure.

Further, at the end of the seam confronting the electrode layer, the thickness of the seam differs from another portion. In a case where the belt is seamed by ultrasonic welding, the welding becomes unstable according to the above thickness difference. The strength of the seam confronting the electrode layer accordingly becomes weaker than the other portion of the seam.

By the way, when the oblique seam is confronted with the roller, the stress acting on the upstream side end of the seam is greater than that acting on the downstream side end of the seam. Therefore, the upstream side of the seam is liable to break firstly.

Therefore, in a case where the oblique seam is extended such that an end of the seam confronting the electrode layer is situated in the downstream side, even when the upstream side of the seam is broken firstly, the broken cannot be recognized by the monitoring the primary transfer current detected through the electrode layer. Since the belt continues to be used under such a condition, the broken portion would damage the cleaning blade, the photoconductive member or the like. In a case where the broken portion comes in contact with a metal plate member disposed in the vicinity of the belt, the voltage applied to the belt would be short-circuited through the metal plate member.

On the other hand, in a case where the oblique seam is extended such that an end of the seam confronting the electrode layer is situated in the upstream side of the belt circulating direction, since the larger stress acts on the relatively weak portion of the seam, the lifetime of the belt would be shortened. Further, in a case where the bias voltage is applied to the electrode layer through a roller member, a plate spring or the like, the broken portion is likely to be caught by such members, so that the breakage would progress in an instant.

In order to enhance the accuracy of the color lamination on the intermediate transfer belt, or in order to prevent the image or the recording medium from being placed on the seam, a mark is provided on the belt and the mark is detected by a reflective sensor to determine the position of the belt Although there is a case where a mark is printed on the belt so as to have a different color from the color of the belt, erroneous operation would be caused when the mark is dirtied with toner or dust. In order to secure the position detection, Japanese Patent No. 3025070 discloses a hole is formed on the belt as the mark. On the other hand, Japanese Patent Publication No. 2001-343864A discloses that a projection is formed on one widthwise end of the belt, and the projection is detected by a transmissive sensor to determine the position of the belt.

In order to avoid the loss of optical gain, in the case of the reflective sensor, the distance between the sensor and the reflective face of the belt is made small. In the case of the transmissive sensor, the distance between the light emitter and the light receiver is made small.

The sensor is preferably placed in the vicinity of the roller suspending the belt because the motion of the belt is stabilized thereat. However, in the case of the reflective sensor, the sensor is placed at a portion of the belt which is not wound on the roller in order to avoid the loss of optical gain. In the case of the transmissive sensor, the sensor is placed away from the roller to avoid the interference of the roller shaft. Although this problem can be avoid if the roller diameter is made large, this is contrary to the downsizing requirement in recent years.

In a case where the belt suspended by the rollers are stopped for a long time period during the deactivation of the apparatus, the belt is crept in accordance with the shape of the roller to form a bent curl. Further, the creep is produced also by a contact member such as a cleaner blade, a contact cleaning mechanism at an inner face of belt or the like other than the roller.

Although the thickness of the belt may be reduced to avoid the creep, this is contrary to the requirement that the thickness of the belt is made thick to prevent the belt being stretched in order to suppress the positioning deviation of the respective color images.

Although the tension applied to the belt may be released mechanically, it is necessary to provide an additional mechanism to perform the release operation, thereby disabling the downsizing of the apparatus. Further, since it is necessary to again apply the tension from the released condition when the printing operation is activated, there poses a problem that a time is taken from instructing to print to starting to print Although it is unavoidable that creep is produced at the belt at a portion thereof made to wrap on the roller, when the belt is stopped, there is a case where the position detecting hole or the position detecting projection of the belt is brought into a state of being made to wrap on the roller. In that case, when the belt is moved again, in the case of the reflective sensor, the position detecting hole is deformed and therefore, gain of reflection is reduced and accuracy of detecting the position is deteriorated. Further, the sensor is liabl to be brought into contact with uneven portions produced by the deformation to wear the detection mark to pose a problem that the position is detected inaccurately.

Further, in the case of the transmissive sensor, there is a case where uneven portions produced at the position detecting portion are liable to be caught by the small interval between the light emitter and the light receiver to break the belt. This problem is more remarkable in a case where the projection extended from one width end of the belt is used as the position detecting portion.

Japanese Patent Publication Nos. 10-221967A, 11-184203A and 2002-91107A disclose an image forming apparatus in which a cleaning member and a secondary transfer roller, each of which is brought into contact with or separated from the intermediate transfer belt to remove toner remaining thereon after the superposed toner images on the intermediate transfer belt is collectively transferred onto a recording medium (secondary transfer).

In such an image forming apparatus, when the cleaning blade or the secondary transfer roller is brought into contact with the intermediate transfer belt, impact or vibration effects influence on forming an image, as a result, a failure in image formation such as banding is brought about. Further, toner is scattered to float by the impact, conduction failure would be brought about when the floated toner is adhered to a conductive member in the apparatus.

In the apparatus disclosed in the above publications, the cleaning blade or the secondary transfer roller is brought into contact with the intermediate transfer belt entirely and simultaneously in the widthwise direction thereof. Such operation generates a relatively large impact to scatter the toner. This problem is more remarkable in a case where an endless belt member provided with a seam is used (disclosed in Japanese Patent Publication No. 8-305112A).

Further, in a case where the seam is obliquely extended relative to the circulating direction of the belt as disclosed in this publication, and in a case where the cleaning member or the secondary transfer member is so configured as to be brought into contact with the belt while avoiding the seam, it is difficult to downsize the intermediate transfer belt because a non-image forming region is accordingly enlarged.

SUMMARY OF THE INVENTION

It is therefore an object of the invention to provide an image forming apparatus capable of preventing an electrode layer formed with an endless intermediate transfer belt from being contaminated by toner conveyed by a cleaning blade along a seam of the bell It is also an object of the invention to provide an image forming apparatus capable of immediately and certainly detecting the breakage of a seam of an endless belt member.

In order to achieve the above objects, according to the invention, there is provided an image forming apparatus, comprising:

a belt member, seamed to form an endless belt which is stretched by a plurality of roller members and circulated in a first direction, the belt member provided with an electrode portion at a first end portion thereof in a second direction perpendicular to the first direction; and a cleaning member, abutted against the belt member, wherein a seam of the belt member extends obliquely relative to the first direction such that an end of the seam confronting the electrode portion is situated in an upstream side of the first direction.

Preferably, the belt member comprises a substrate, a conductive layer laminated on the substrate, and a semiconductive layer laminated on the conductive layer so as to have a smaller dimension than the conductive layer in the second direction. Here, the electrode portion is formed on both of the conductive layer and the semiconductive layer.

Preferably, the image forming apparatus further comprises an electrode roller abutted against the electrode portion to apply a bias voltage for primarily transferring a toner image on the belt member.

Preferably, the image forming apparatus further comprises a sensor, which monitors the bias voltage to detect a breakage of the seam.

It is also an object of the invention to provide an image forming apparatus capable of reducing the stress acting on a seam of an endless belt member when the seam is confronted with a roller suspending the belt member, in order to prolong the lifetime of the belt member.

In order to achieve the above object, according to the invention, there is provided an image forming apparatus, comprising:

a belt member, seamed to form an endless belt which is stretched by a plurality of roller members and circulated in a first direction, the belt member provided with an electrode portion at a first end portion thereof in a second direction perpendicular to the first direction; and a cleaning member, abutted against the belt member, wherein a seam of the belt member extends obliquely relative to the first direction such that an end of the seam confronting the electrode portion is situated in a downstream side of the first direction.

Preferably, the belt member comprises a substrate, a conductive layer laminated on the substrate, and a semiconductive layer laminated on the conductive layer so as to have a smaller dimension than the conductive layer in the second direction. Here, the electrode portion is formed on both of the conductive layer and the semiconductive layer.

Preferably, the image forming apparatus further comprises an electrode roller abutted against the electrode portion to apply a bias voltage for primarily transferring a toner image on the belt member.

It is also an object of the invention to provide an image forming apparatus capable of eliminating an influence on the detection of the position of an endless belt member due to creep formed thereon and the breakage of the belt member.

In order to achieve the above object, according to the invention, there is provided an image forming apparatus, comprising:

a belt member, seamed to form an endless belt which is stretched and circulated by a plurality of roller members, the belt member provided with an indicator which indicates a reference position of the circulation of the belt member; and a controller, which stops the circulation of the belt member such that the indicator is situated at a position between adjacent ones of the rollers.

Preferably, the adjacent rollers are ones arranged with a largest interval.

It is also an object of the invention to provide an image forming apparatus capable of alleviating impact generated when a cleaning member or a secondary transfer member is brought into contact with an intermediate transfer member.

In order to achieve the above object, according to the invention, there is provided an image forming apparatus, comprising:

a belt member, seamed to form an endless belt which is stretched and circulated by a plurality of roller members, the belt member provided with a first region corresponding to an image forming region, and a second region provided with a seam of the belt member and corresponding to a non-image forming region;

a cleaning member, which is abutted against the belt member; and a mechanism, which first bring the cleaning member into contact with a first widthwise end portion in the second region of the belt member, so that the cleaning member is entirely brought into contact with the belt member at a second widthwise end portion in the second region thereof, wherein a track of a contact point between the cleaning member and the belt member extends so as to avoid the seam.

Preferably, the belt member is provided with an electrode portion at the first widthwise end thereof, through which a bias voltage for primarily transferring a toner image is applied.

Preferably, the mechanism first separate the cleaning member from the second widthwise end portion of the belt member, so that the cleaning member is entirely separated from the belt member at the first widthwise end portion thereof.

According to the invention, there is also provided an image forming apparatus, comprising:

a belt member, seamed to form an endless belt which is stretched and circulated by a plurality of roller members, the belt member provided with a first region corresponding to an image forming region, and a second region provided with a seam of the belt member and corresponding to a non-image forming region;

a cleaning member, which is abutted against the belt member; and a mechanism, which first bring the cleaning member into contact with a first widthwise end portion in the second region of the belt member, so that the cleaning member is entirely brought into contact with the belt member at a second widthwise end portion in the second region thereof, wherein a track of a contact point between the cleaning member and the belt member extends so as to cross the seam.

Preferably, the belt member is provided with an electrode portion at the first widthwise end thereof, through which a bias voltage for primarily transferring a toner image is applied.

Preferably, the mechanism first separate the cleaning member from the second widthwise end portion of the belt member, so that the cleaning member is entirely separated from the belt member at the first widthwise end portion thereof.

According to the invention, there is also provided an image forming apparatus, comprising:

a belt member, seamed to form an endless belt which is stretched and circulated by a plurality of roller members, the belt member provided with a first region onto which a toner image is primarily transferred, and a second region provided with a seam of the belt member and onto which the toner image is not transferred;

a secondary transfer member, which is abutted against the belt member to secondarily transfer the toner image from the belt member to a recording medium; and a mechanism, which first bring the secondary transfer member into contact with a first widthwise end portion in the second region of the belt member, so that the secondary transfer member is entirely brought into contact with the belt member at a second widthwise end portion in the second region thereof, wherein a track of a contact point between the secondary transfer member and the belt member extends so as to avoid the seam.

Preferably, the belt member is provided with an electrode portion at the first widthwise end thereof, through which a bias voltage for primarily transferring the toner image is applied.

Preferably, the mechanism first separate the secondary transfer member from the second widthwise end portion of the belt member, so that the secondary transfer member is entirely separated from the belt member at the first widthwise end portion thereof.

According to the invention, there is also provided an image forming apparatus, comprising:

a belt member, seamed to form an endless belt which is stretched and circulated by a plurality of roller members, the belt member provided with a first region onto which a toner image is primarily transferred, and a second region provided with a seam of the belt member and onto which the toner image is not transferred;

a secondary transfer member, which is abutted against the belt member to secondarily transfer the toner image from the belt member to a recording medium; and a mechanism, which first bring the secondary transfer member into contact with a first widthwise end portion in the second region of the belt member, so that the secondary transfer member is entirely brought into contact with the belt member at a second widthwise end portion in the second region thereof, wherein a track of a contact point between the secondary transfer member and the belt member extends so as to cross the seam.

Preferably, the belt member is provided with an electrode portion at the first widthwise end thereof, through which a bias voltage for primarily transferring the toner image is applied.

Preferably, the mechanism first separate the cleaning member from the second widthwise end portion of the belt member, so that the cleaning member is entirely separated from the belt member at the first widthwise end portion thereof.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Preferred embodiments of the invention will be described below in detail with reference to the accompanying drawings.

Figure 1:
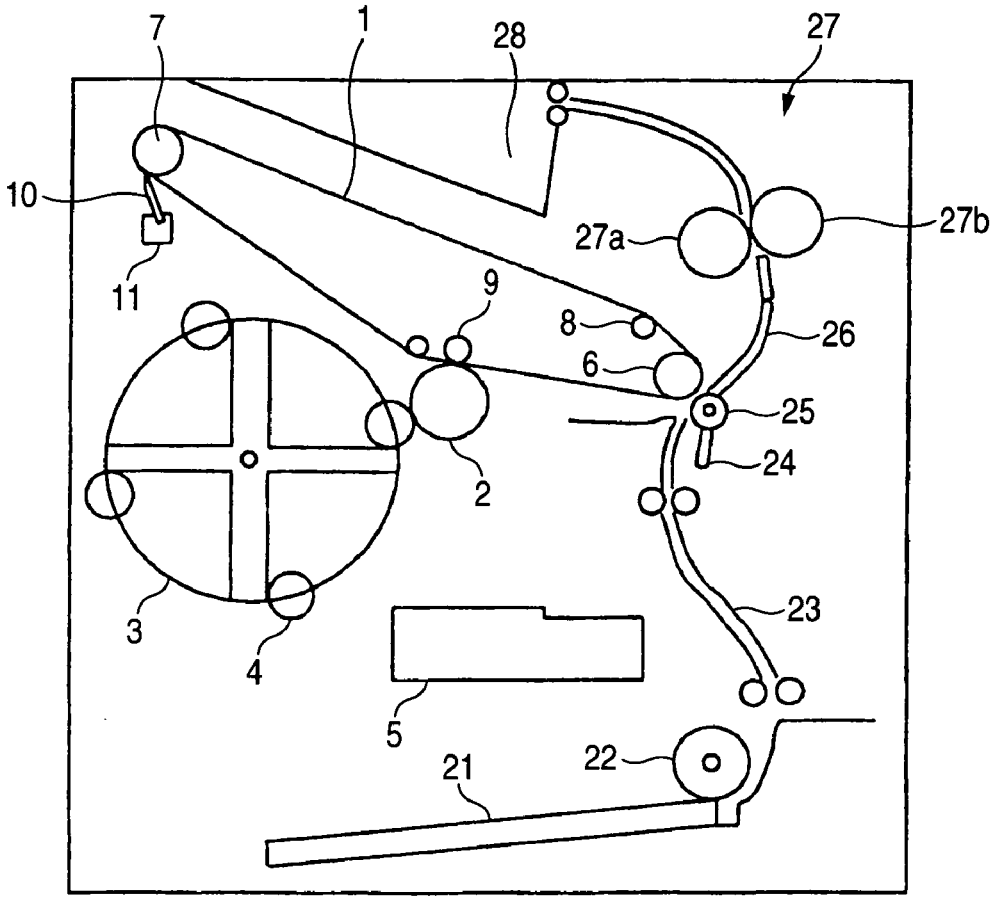
FIG. 1 is a schematic side view showing an image forming apparatus according to a first embodiment of the invention.

FIG. 1 shows an image forming apparatus according to a first embodiment of the invention. A photoconductive member 2 is uniformly charged by a charger (not illustrated) and an electrostatic latent image is formed by irradiating the photoconductive member 2 with light from an exposer 5. A rotary type developer 3 for subjecting the electrostatic latent image to toner development comprises four colors (yellow, magenta, cyan and black) of developing rollers 4 each brought to a position confronting the photoconductive member 2 by intermittent rotation of the rotary type developer 3 to carry out the toner development An intermediate transfer belt 1 is stretched by a drive roller 6, a driven roller 7, a tension roller 8, a primary transfer roller 9. The primary transfer roller 9 is brought into contact with the photoconductive member 2 through the intermediate transfer belt 1, so that the toner image formed on the photoconductive member 2 is transferred onto the intermediate transfer belt 1 (primary transfer, lamination of the toner images of four colors).

A secondary transfer roller 25 brought into contact with and separated from the intermediate transfer belt 1 by a switching mechanism 24 is provided at a position opposed to the drive roller 6, so that the toner images of four colors on the intermediate transfer belt 1 are collectively transferred on to a recording medium (secondary transfer). Here, the drive roller 6 also serves as a backup roller for the secondary transfer.

The recording medium (e.g., a sheet of paper) fed by a feeding roller 22 from a tray 21 passes a transporting path 23 to reach a position confronting the secondary transfer roller 25 (secondary transfer position). While the primary transfer is performed, the secondary transfer roller 25 is separated from the intermediate transfer belt 1. When the secondary transfer roller is brought into contact with the intermediate transfer belt 1, a transfer bias voltage is applied to perform the secondary transfer. The recording medium to which the secondary transfer is performed is introduced, via a guide path 26, into a fixer 27 comprising a heating roller 27*a* and a press roller 27*b*, and is discharged to an ejection tray 28 provided at a top face of the apparatus.

A cleaning blade 10 brought into contact with and separated from the intermediate transfer belt 1 by a switching mechanism 11 is provided to remove toner remaining on the intermediate transfer belt 1 after the secondary transfer is performed. Here, the driven roller 7 also serves as a backup roller and brought into contact therewith after secondary transcription to remove the toner remaining. A cleaning member is not limited to the cleaning blade but is applicable to any of a brush, a roller, a sheet and the like.

Figure 2:
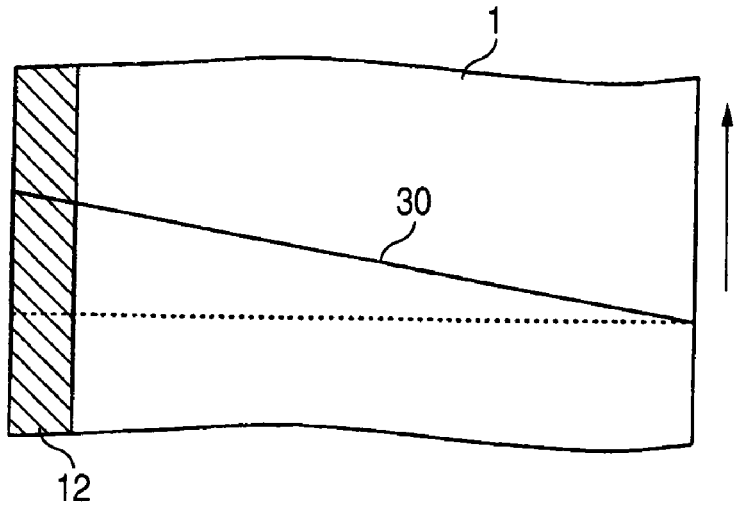
FIG. 2 is a schematic plan view showing a seam formed on an intermediate transfer belt in the image forming apparatus of FIG. 1.

In this embodiment, as shown in FIG. 2, an intermediate transfer belt 1 is formed in an endless shape by being seamed such that a seam 30 extends obliquely relative to the circulating direction of the belt (indicated by an arrow). Specifically, the end of the seam 30 confronting an electrode layer 12 is situated in the upstream side of the circulating direction.

Figure 3:
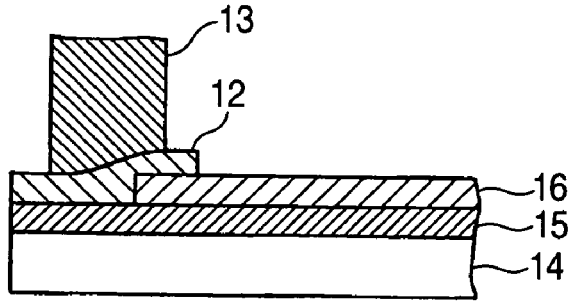
FIG. 3 is an enlarged section view of the intermediate transfer belt showing one widthwise end thereof.

As shown in FIG. 3, the intermediate transfer belt 1 is constituted by a three-layered structure in which a conductive layer 15 of aluminum or the like is laminated on a substrate 14 comprised of PET and a surface thereof is formed with a semiconductive layer (coating) 6. One widthwise end of the belt 1 is entirely formed with a portion which is not coated with the conductive layer 16, an electrode layer 12 for primary transfer is formed on a surface of the exposed conductive layer 15 so as to partially extend to a surface of the semiconductive layer 16. An electrode roller 13 for primary transfer is brought into contact with the electrode layer 12 to thereby apply transfer bias voltage on the conductive layer 15.

Figure 4:
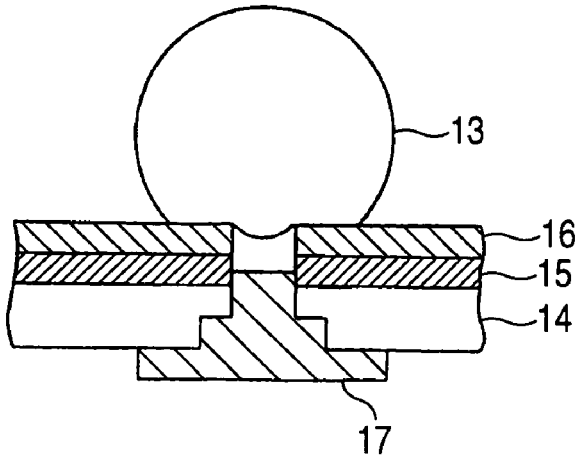
FIG. 4 is an enlarged section view of the intermediate transfer belt showing a seamed portion thereof.

As shown in FIG. 4, the intermediate transfer belt 1 is seamed at a weld portion 17 by ultrasonic welding from a back side of the substrate 14 to form the seam 30. When viewed microscopically, at the seam 30, the electrode layer 12 and the conductive layer 15 are separated and the electrode roller 13 is in the form of being brought into contact to ride over the separated ends.

The intermediate transfer belt 1 is stretched by a plurality of pieces of rollers. As described the above, in a case where the seam is extended obliquely relative to the circulating direction of the belt, very large stress acts on the seam when the seam is confronted with the roller. Further, since the strength of the end of the seam confronting the electrode layer is relatively weak in comparison with another portion of the seam, this portion is liable to be broken firstly.

In this embodiment, since the end of the seam 30 confronting the electrode layer 12 is situated in the upstream side of the belt circulating direction, the breakage of the belt is first brought about at the side of the electrode layer 12. In a case where the power source for the primary transfer is a constant voltage power source, by monitoring current thereof, a reduction in a current value when the electrode roller 13 passes the broken portion of the belt can be confirmed.

Figure 5:
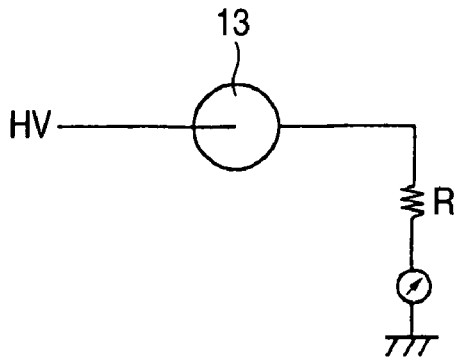
FIG. 5 is a diagram for explaining how to detect the breakage of the intermediate transfer belt.

That is, when voltage is applied from a constant voltage power source (HV) through the electrode roller 13 as shown in FIG. 5 predetermined current determined by resistance R of the belt is made to flow and by monitoring current or voltage at this occasion, it can be detected whether the belt is broken.

In this way, breakage of the belt can be detected at an early stage, operation of the machine can be stopped so that the belt can be prevented from continuing to use in the broken state. In a case where the breakage of the belt is detected by using an optical sensor or the like, by arranging such a sensor on the side of the electrode layer 12 which is liable to break firstly, breakage of the seam 30 can surely be detected at an early stage.

Further, according to the above configuration, the end of the seam 30 confronting the electrode layer 12 is first brought into contact with the cleaning blade 10 (not shown in FIG. 2). Therefore, the toner scraped by the cleaning blade 10 is conveyed along the seam toward the opposite end of the seam 30, so that the electrode layer 12 is prevented from being contaminated.

Figure 6:
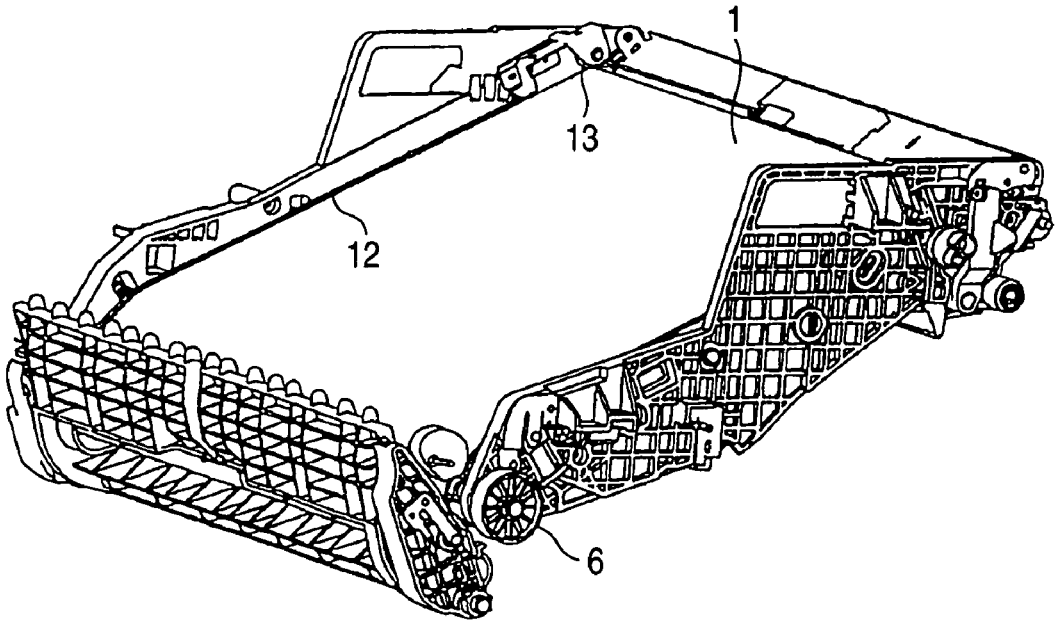
FIG. 6 is a perspective view showing an entire configuration of an intermediate transfer unit in the image forming apparatus of FIG. 1.
Figure 7:
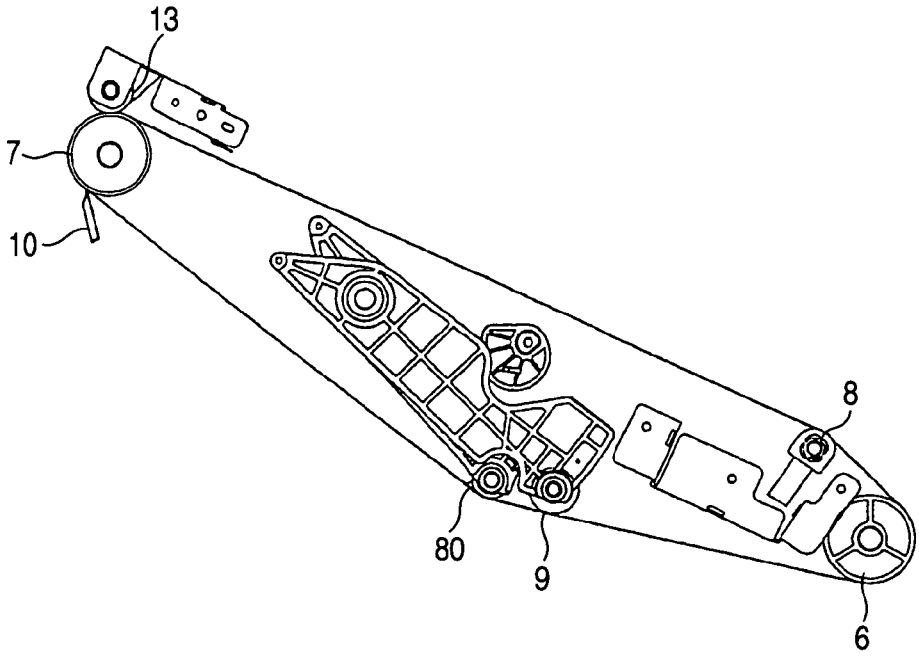
FIG. 7 is a side view showing an essential part of the intermediate transfer unit.

FIG. 6 shows an entire configuration of an intermediate transfer unit FIG. 7 shows an essential part of the intermediate transfer unit.

An end portion of the intermediate transfer unit is provided with a drive roller 6 to drive the intermediate transfer belt 1, one widthwise end portion of the belt is formed with the electrode layer 12. The electrode roller 13 is rotated by being brought into contact with the electrode layer 12. The intermediate transfer belt 1 is circulated in a predetermined direction by the drive roller 6 and a driven roller 7 and is exerted with constant tension by a tension roller 8. A backup roller 9 for primary transfer and a support roller 80 made of a metal for defining a nip width of the backup roller 9. Further, a cleaning blade 10 for cleaning a surface of the belt is brought into contact with a portion of the belt opposed to the driven roller 7.

Figure 8:
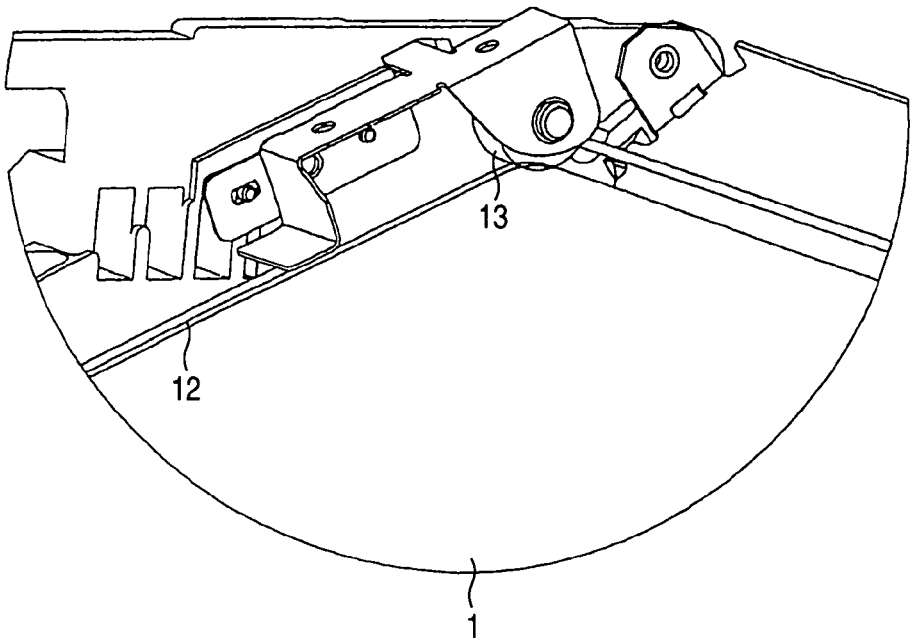
FIG. 8 is an enlarged perspective view showing an electrode roller for primary transfer in the intermediate transfer unit.

As shown in FIGS. 7 and 8, the electrode roller 13 made of elastic rubber is disposed at a position opposed to the driven roller 7 to apply voltage of 220V to the electrode layer 12.

The toner image reaches the primary transfer position after having been processed by steps of charge, exposure and development in accordance with rotation of the photoconductive member 2. At the primary transfer position, the backup roller 9 provided at a position opposed to the photoconductive member 2 is urged toward the side of the photoconductive member 2 by force of a spring or the like. The intermediate transfer belt 1 and the photoconductive member 2 are brought into contact with each other under constant pressure by the force.

In this embodiment, the substrate 14 is a PET film of 0.15 mm. The conductive layer 15 is a layer deposited with aluminum or the like on the substrate 14. The conductive layer 15 is coated with a semiconductive coating 16 by a thickness of 0.02 mm. Further, the end portion of the belt 1 is provided with a region which is not provided with the coating 16 and the electrode layer 12 made of carbon is provided on the conductive layer 15 by a width of 5 mm.

The intermediate transfer belt 1 is constituted by seaming a sheet-shaped member in an endless shape. A PET film is brought into contact with the back side of the belt and subjected to ultrasonic welding to form the seam 30.

The electrode roller 13 is applied with bias voltage from a high-voltage power source HV (see FIG. 5) so that the bias voltage is applied to the conductive layer 12 to uniformly charge the intermediate transfer belt 1. The high-voltage power source is a constant-voltage power source in which an output current can be monitored. The toner image reaching the primary transfer position is nipped by the photoconductive member 2 and the intermediate transfer belt 1 and is primarily transferred onto the intermediate transfer belt 1 by the primary transfer bias voltage applied to the conductive layer 12. This transfer is carried out for each color toner image successively formed on the photoconductive member 2 so that the color toner images are superposed on the intermediate transfer belt 1. At this occasion, the secondary transfer roller 24 and the cleaning blade 10 are maintained in a separated state in order not to disturb the toner images on the intermediate transfer belt 1.

After the primary transfer for the final color toner image is completed, the superposed toner images are conveyed to the secondary transfer position in accordance with the circulation of the intermediate transfer belt 1. At the same time, a recording medium (not shown) is fed to from the tray 21 to the secondary transfer position so that the superposed toner images are collectively transferred thereon.

Toner which has not been subjected to the secondary transfer and remaining on the intermediate transfer belt 1 is conveyed to a cleaning position. At the same time, the cleaning blade 10 is brought into contact with the belt 1 to scrape off the remaining toner. Although most of the scraped toner is collected by a cleaner housing (not shown), a part of the scraped toner stays at the leading edge of the cleaning blade 10. When the seam 30 reaches the leading edge of the cleaning blad 10, the stayed toner is conveyed along the seam 30 in accordance with the movement of the belt 1. Here, since the end of the seam 30 confronting the electrode layer 12 is situated in the upstream side of the belt circulating direction and is first brought into contact with the cleaning blade 10, the electrode layer 12 is prevented from being contaminated. The obliquely conveyed toner is scraped and sealed by a sealing member disposed as the opposite end of the seam 30, so that the scraped toner is prevented from scattering to outside of the cleaner.

Figure 9:
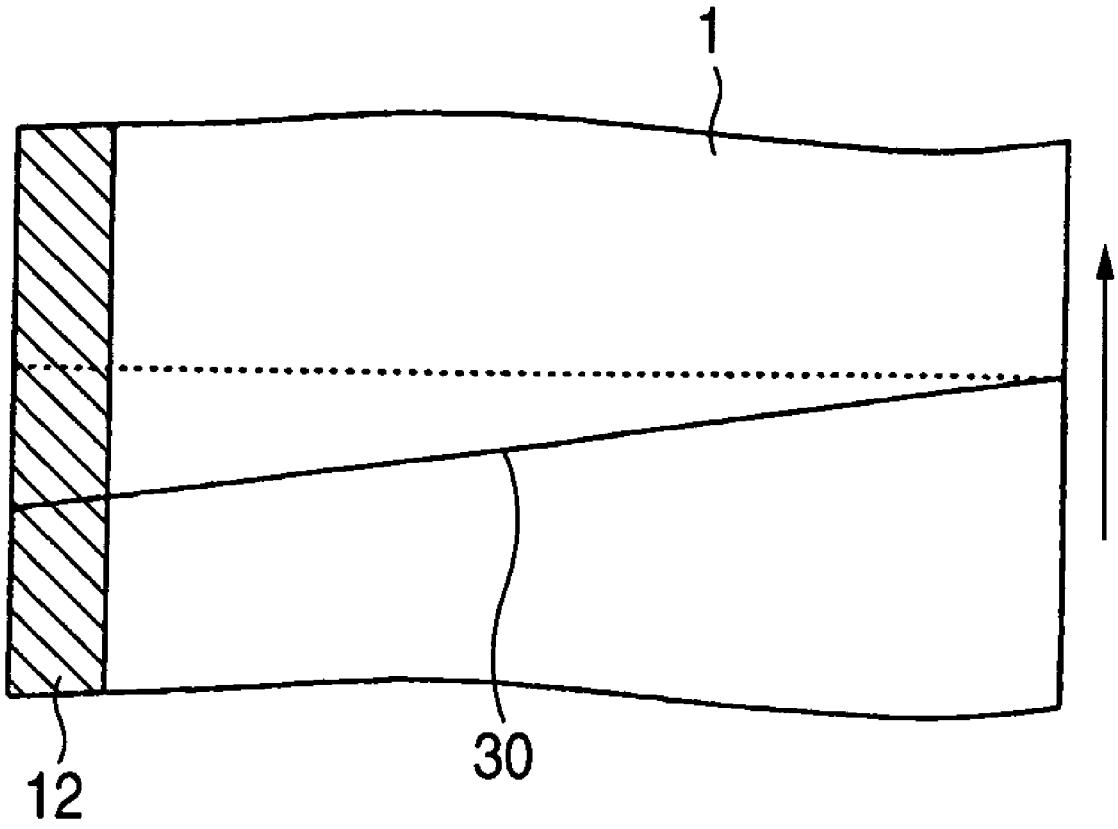
FIG. 9 is a schematic plan view showing a seam formed on an intermediate transfer belt according to a second embodiment of the invention.

FIG. 9 shows a second embodiment of the invention. In this embodiment, an intermediate transfer belt 1 is formed in an endless shape by being seamed such that a seam 30 extends obliquely relative to the circulating direction of the belt (indicated by an arrow). Specifically, the end of the seam 30 confronting an electrode layer 12 is situated in the downstream side of the belt circulating direction.

As described the above, in a case where the seam is extended obliquely relative to the circulating direction of the belt, very large stress acts on the seam when the seam is confronted with the roller. Further, since the strength of the end of the seam confronting the electrode layer is relatively weak in comparison with another portion of the seam, this portion is liable to be broken firstly.

In this embodiment, since the end of the seam 30 confronting the electrode layer 12 is situated in the downstream side of the belt circulating direction, the stress acting on the above end of the seam 30 can be alleviated, so that the lifetime of the belt 1 can be prolonged.

Figure 10:
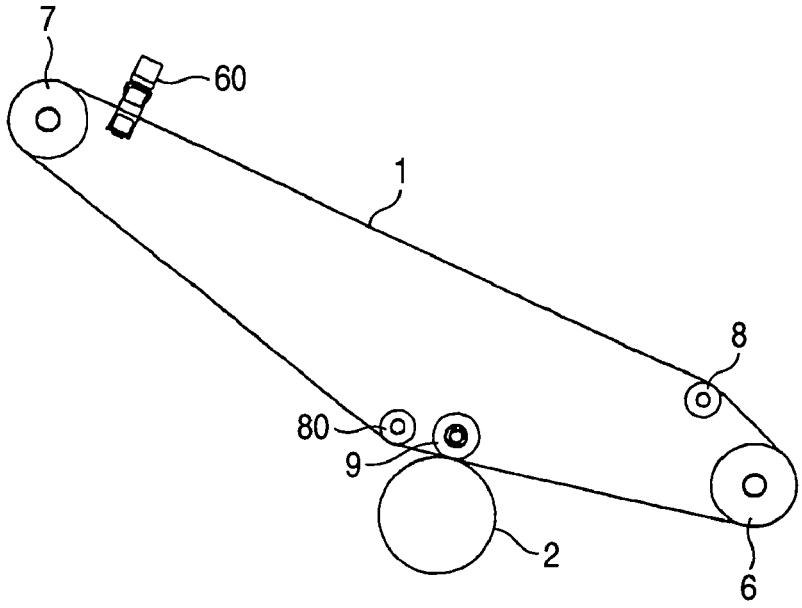
FIG. 10 is a side view showing an essential part of an intermediate transfer unit according to a third embodiment of the invention.

FIG. 10 shows a third embodiment of th invention. Elements similar to those in the above embodiment are designated by the same reference numerals and the repetitive explanations for those will be omitted here.

The intermediate transfer belt 1 brought into contact with and separated from the photoconductive member 1 is stretched basically by the drive roller 3 and the driven roller 4 which are diametrically arranged to be opposed to each other and exerted with predetermined tension by the primary transferring backup roller 5 arranged opposedly to the photoconductive member 1 by interposing the intermediate transfer belt 1, the support roller 6 made of a metal for ensuring nip of the backup roller and the tension roller 7. Further, even when the primary transferring backup roller 5 is regressed to separate from the intermediate transfer belt 1, the intermediate transfer belt 1 is not slacked by being exerted with constant tension by tension exerted by the tension roller 7. Further, although all of the rollers other than the drive roller are driven rollers, the driven roller 4 serves also as a cleaner backup roller and a cleaning blade (not illustrates) for cleaning the surface of the belt is brought into contact with a portion opposed thereto.

FIG. 10 shows a third embodiment of the invention. Elements similar to those in the above embodiments are designated by the same reference numerals and the repetitive explanations for those will be omitted here.

Since the intermediate transfer belt 1 is formed with the seam, an image must be formed on the belt 1 so as to avoid the seam. In this embodiment, a position sensor 60 is provided to detect a reference position of the belt 1 so that the toner image formed thereon avoids the seam. Specifically, the position sensor 60 is disposed so as to avoid the rollers on which the belt 1 is wound, but is disposed in the vicinity of the driven roller 7 at which the motion of the belt 1 is relatively made stable.

Figure 11:
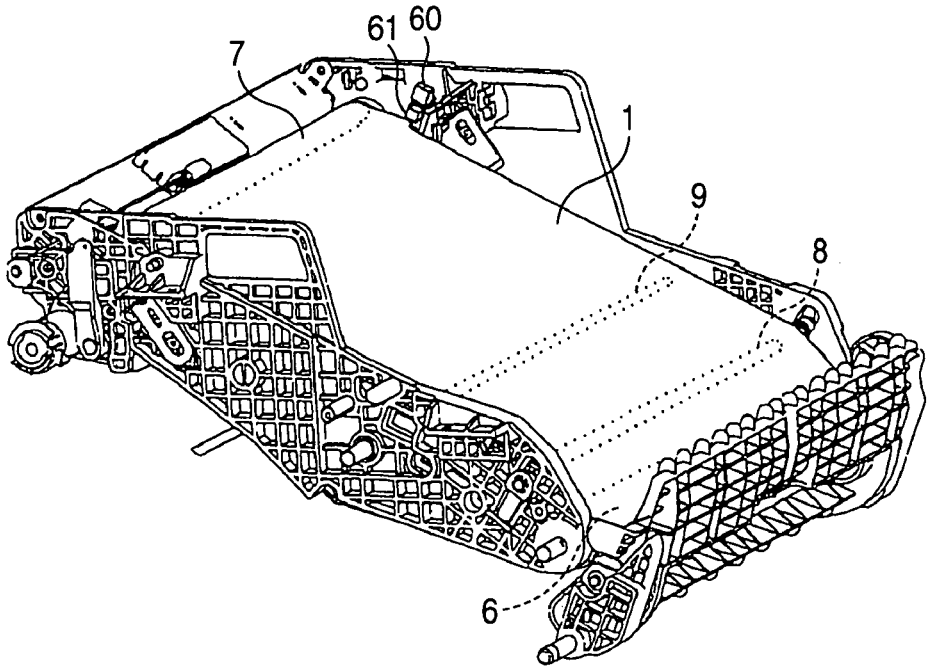
FIG. 11 is a perspective view showing an entire configuration of the intermediate transfer unit of FIG. 10.
Figure 12:
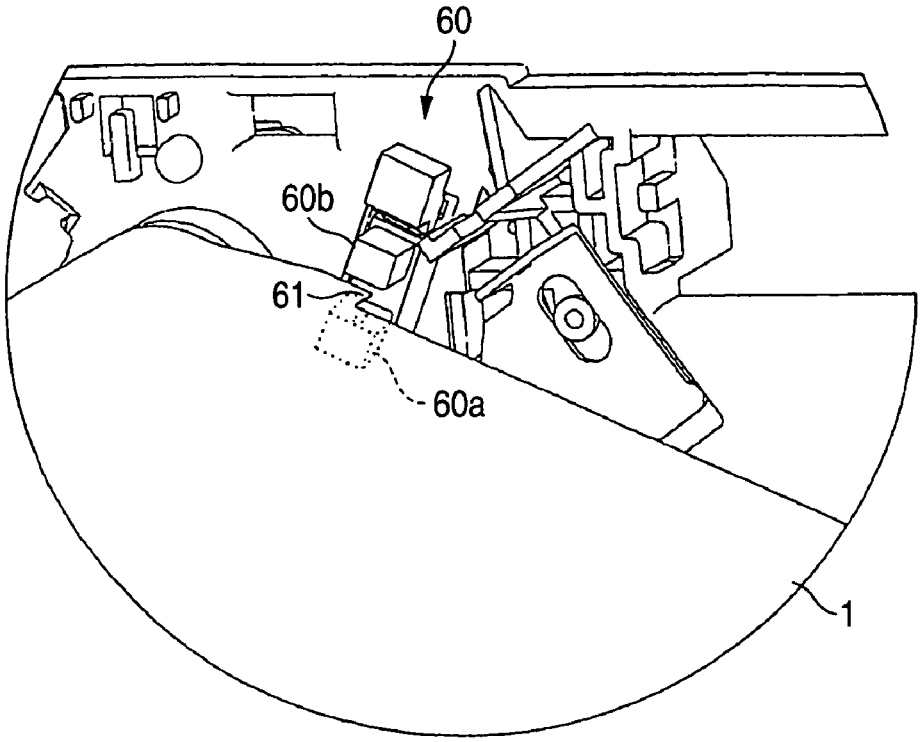
FIG. 12 is an enlarged perspective view showing a position sensor in the intermediate transfer unit of FIG. 10.

As shown in FIGS. 11 and 12, a projection 61 is formed at a side edge of the intermediate transfer belt 1 as a reference position thereof to be detected by the position sensor 60. In this embodiment, the position sensor 60 comprises a light emitter 60*a* and a light receiver 61*b* so that the reference position is detected when the projection 61 passes through a gap between the light emitter 60*a* and the light receiver 60*b* to shade the light from the light emitter 60*a*.

As described above, the intermediate transfer belt 1 is stretched by the rollers and when the apparatus is brought into a stationary state for a long time period, a portion of the belt wrapped on the roller is crept to the shape of the roller and the bent curl is formed. Further, the creep is produced also by another not-shown contact member such as the cleaning blade. When the projection 61 is situated at the portion formed with the bent curl, the portion of the projection 61 is deformed and the accuracy of detection is deteriorated.

Hence, in this embodiment, the position of the projection 61 is controlled such that the projection 61 is prevented from being placed at a portion wrapping on the roller when the intermediate transfer belt 1 is stopped. Naturally, the above control is similarly carried out even in a case where a hole, a mark or the like is used as a position indicator.

Figure 13:
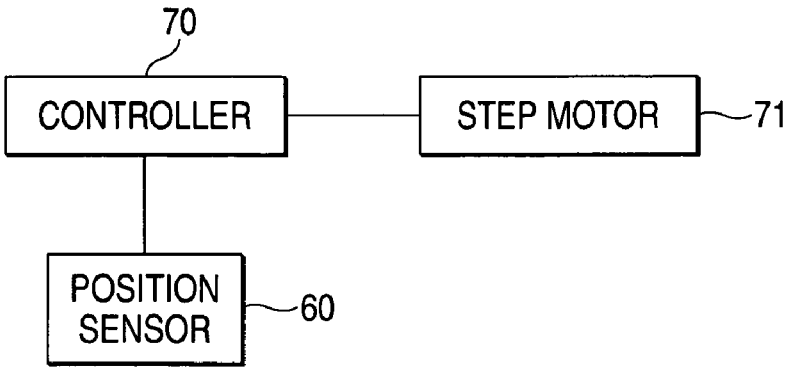
FIG. 13 is a block diagram for explaining how to control the position of a projection in the intermediate transfer unit of FIG. 10.

As shown in FIG. 13, a step motor 71 for driving to rotate the drive roller 6 for circulating the belt 1 is controlled to drive by a controller 70 comprising CPU (central processing unit) and the like. The controller 70 receives a signal of detecting the projection 61 from the position sensor 60. When the apparatus is stopped, the controller 70 calculates the distance that the projection 61 is moved from the position sensor 60, based on a time period measured by an internal timer or the step number of the step motor 71, and controls such that the projection 61 is stopped at a position where the belt 1 is made to be flat while avoiding the positions wrapping on the rollers. Therefore, the projector 61 is not deformed after having been stopped for a long time period.

As the stop position of the projection, in view of the stableness of the flat condition of the belt 1, a position between rollers providing a tension to the belt 1 is preferable.

The intermediate transfer belt is exemplified in this embodiment. However, it is applicable in a case where the belt member is used as a photoconductive member or a medium transporting member.

Specific numerical examples will be shown below to explain the advantages of the invention.

EXAMPLE 1

As an intermediate transfer belt, a metal layer was vapor-deposited on a substrate of a PET (polyethyleneterephthalate) film having a thickness of 130 μm, and a Coating dispersed with a conductive material having medium resistance was coated on the metal layer. A projection was formed at a side edge of the belt as a reference position thereof. The projection was detected by a transmissive optical sensor. An interval between a light emitter and a light receiver was 5 mm. The belt was stretched by a drive roller and a plurality of driven rollers.

In stopping the belt, the belt was controlled to stop such that the projection was deviated from portions wrapping on the rollers. When the belt it was stopped for a long time period under the state, unevenness was produced at portions of the belt crept by the rollers. Since the projection was situated so as to avoid the portions wrapping on the rollers, any deformation was not formed on the projection. Using this belt, no damage was occurred on the position sensor, no image offset was occurred on the intermediate transfer belt, and long time use was attained without any trouble.

EXAMPLE 2

As an intermediate transfer belt, a substrate of ETFT (ethylenetetrafluoroethylene copolymer) having a thickness of 150 μm dispersed with carbon was used. A mark was painted on a side end portion of the belt as the reference position. A reflective sensor was disposed at a distance of 3 mm from a surface of the belt. The belt was stretched by a drive roller and a plurality of driven rollers.

In stopping the belt, the belt was controlled to stop such that the projection was deviated from portions wrapping on the rollers. When the belt was stopped for a long time period under the state, unevenness was produced at portions of the belt crept by the rollers. Since the mark was situated so as to avoid the portions wrapping on the rollers, any deformation was not formed on and around the mark. Using this belt, no damage was occurred on the position sensor, no image offset was occurred on the intermediate transfer belt (falls within a range of 10 μm or less).

COMPARATIVE EXAMPLE 1

In stopping the belt, when the belt was stopped such that the projection was disposed at a portion wrapping on the roller. Using this belt after then, the projection was caught by the transmissive sensor, so that no more detecting operation was carried out.

COMPARATIVE EXAMPLE 2

In stopping the belt, when the belt is stopped such that the mark was disposed at a portion of the belt wrapping on the roller. Using this belt after then, the mark is won by the reflective sensor and becomes unclear, so that the image offset was 300 μm.

Figure 14A:
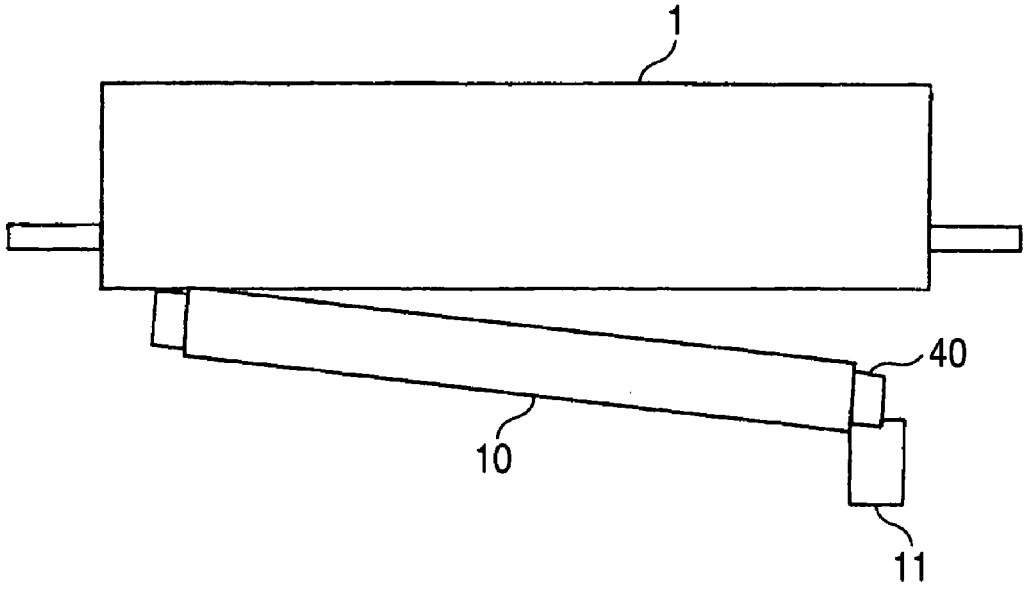
FIGS. 14A and 14B are schematic views showing an intermediate transfer unit according to a fourth embodiment of the invention.
Figure 14B:
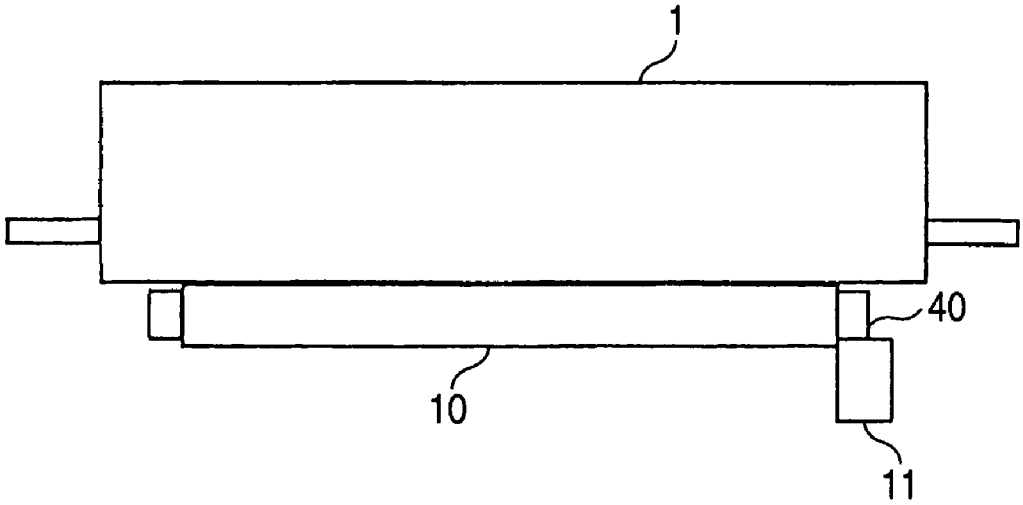

FIGS. 14A and 14B show a fourth embodiment of the invention. Elements similar to those in the above embodiments are designated by the same reference numerals and the repetitive explanations for those will be omitted here.

Figure 15:
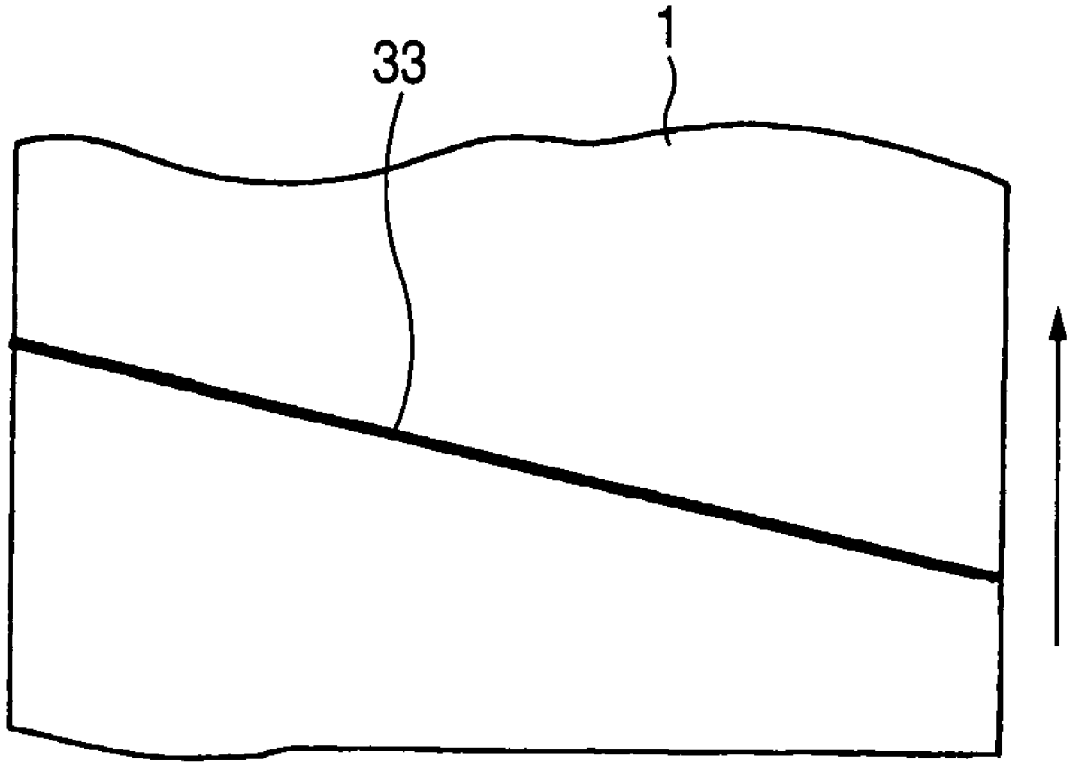
FIG. 15 is an explanatory view showing a contact track of a cleaning blade in the intermediate transfer unit of FIGS. 14A and 14B.

In this embodiment, the intermediate transfer belt 1 is constituted by a single layer structure and voltage is applied from an electrode (not shown) formed on a back face of the belt. By the switching mechanism 11 (described later in detail), the cleaning blade 10 is brought into contact therewith firstly from one longitudinal end thereof (see FIG. 14A) and the contact region is gradually increased until the other longitudinal end thereof is brought into contact with the belt 1 (see FIG. 14B). Therefore, as shown in FIG. 15, in a case where the intermediate transfer belt 1 is circulated in an arrow direction, and the cleaning blade is brought into contact with the belt from the left side in this figure, a contact track 33 of the cleaning blade 10 with respect to the belt 1 extends obliquely relative to the belt circulating direction.

According to the above configuration, impact or vibration becomes inconsiderable in comparison with a case of bringing the cleaning blade into contact with the belt entirely in one motion, so that not only the length of the intermediate transfer belt can be short ned but also scattering of toner or paper powder can be restrained.

Further, as described later in detail, the switching mechanism 11 firstly separates the end of the cleaning blade 10 which is finally brought into contact with the belt 1. Then, the separated region is gradually increased until the end of the cleaning blade 10 which is first brought into contact with the belt 1 is separated. Therefore, impact becomes similarly inconsiderable in comparison with the case where the cleaning blade is entirely separated in one motion, so that scattering of the toner or the like can be prevented.

In this embodiment, the secondary transfer roller 25 is operated to be brought into contact with or separated from the intermediate transfer belt 1, by the switching mechanism 24 (described later in detail) in the same manner as the cleaning blade 10 as described the above. Therefore, scattering of toner can be prevented also in the secondary transfer position.

Figure 16A:
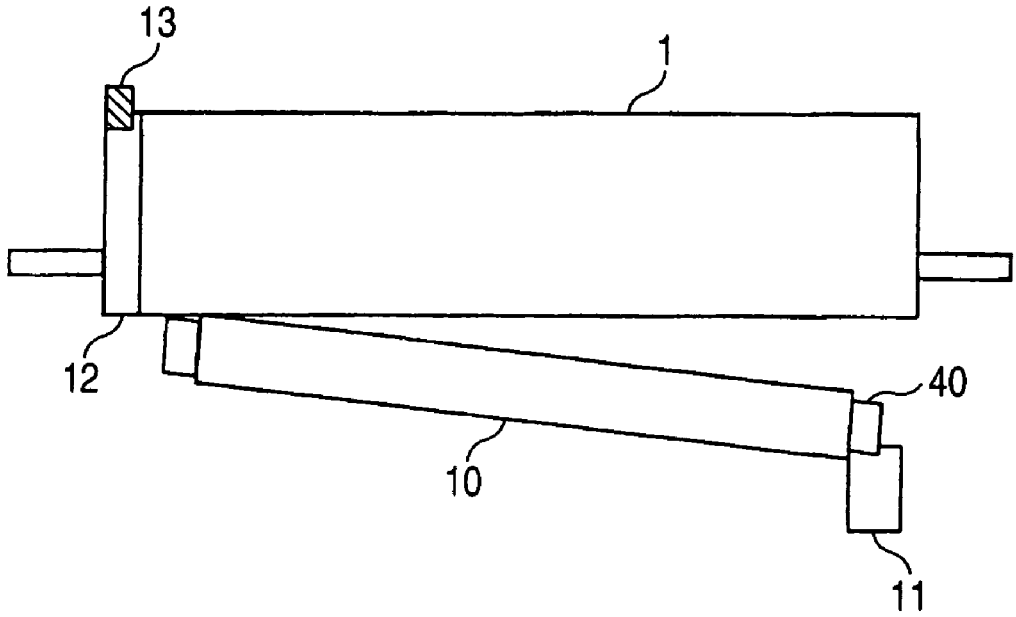
FIGS. 16A and 16B are schematic views showing an intermediate transfer unit according to a fifth embodiment of the invention.
Figure 16B:
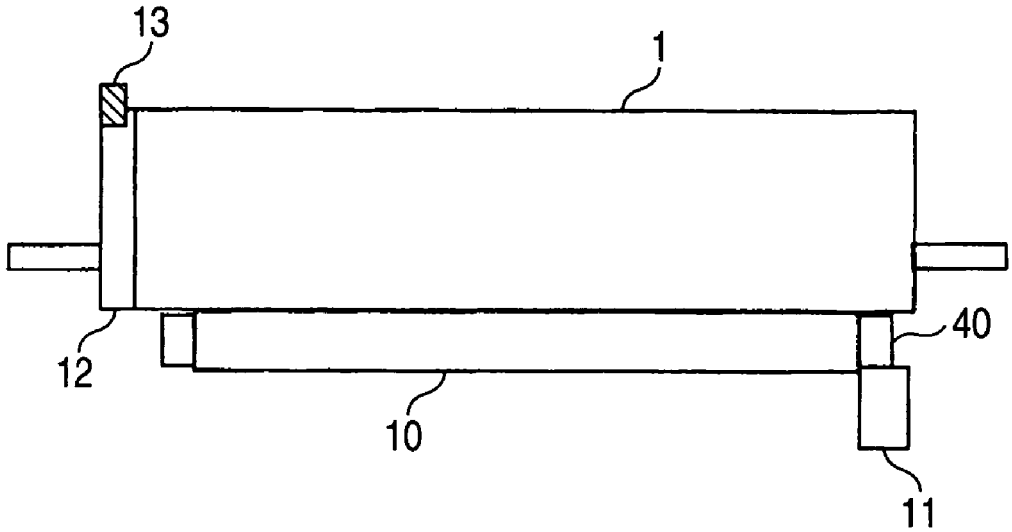

FIGS. 16A and 16B show a fifth embodiment of the invention. Elements similar to those in the above embodiments are designated by the same reference numerals and the repetitive explanations for those will be omitted here.

Figure 17:
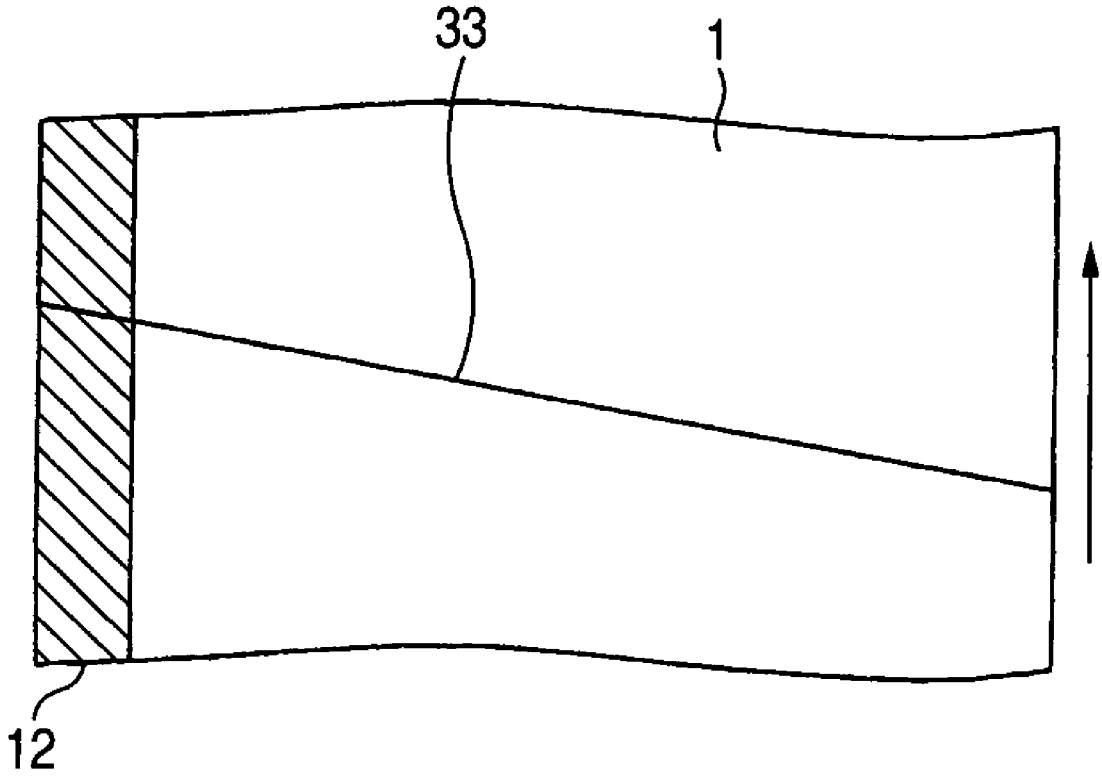
FIG. 17 is an explanatory view showing a contact track of a cleaning blade in the intermediate transfer unit of FIGS. 16A and 16B.

In this embodiment, the intermediate transfer belt 1 is constituted by a multilayer structure as explained in connection with the first embodiment (see FIGS. 3 and 4). By the switching mechanism 11 (described later in detail), the cleaning blade 10 is brought into contact therewith firstly from one end thereof confronting the electrode layer 12 (see FIG. 16A), and the contact region is gradually increased until the other end thereof is brought into contact with the belt 1 (see FIG. 16B). Therefore, as shown in FIG. 17, in a case where the intermediate transfer belt 1 is circulated in an arrow direction, and the cleaning blade is brought into contact with the belt from the left side in this figure, a contact track 33 of the cleaning blade 10 with respect to the belt 1 extends obliquely relative to the belt circulating direction.

According to the above configuration, impact or vibration becomes inconsiderable in comparison with a case of bringing the cleaning blade into contact with the belt entirely in one motion, so that not only the length of the intermediate transfer belt can be shortened but also scattering of toner or paper powder can be restrained.

Further, as described later in detail, the switching mechanism 11 firstly separates the end of the cleaning blade 10 which is finally brought into contact with the belt 1. Then, the separated region is gradually increased until the end of the cleaning blade 10 confronting the electrode layer 12. Therefore, impact becomes similarly inconsiderable in comparison with the case where the cleaning blade is entirely separated in one motion, so that scattering of the toner or the like can be prevented.

Since the end of the cleaning blade 10 confronting the electrode layer 12 is first brought into contact with the belt 1, toner or paper powder is prevented from adhering on the electrode layer 12. Further, since the end of the cleaning blade 10 confronting the electrode layer 12 is finally separated from the belt 1, the electrode layer 12 is prevented from being contaminated.

In this embodiment, the secondary transfer roller 25 is operated to be brought into contact with or separated from the intermediate transfer belt 1, by the switching mechanism 24 (described later in detail) in the same manner as the cleaning blade 10 as described the above. Therefore, scattering of toner can be prevented also in the secondary transfer position. Further, the electrode layer 12 can be prevented from being contaminated also in the secondary transfer position.

Figure 18:
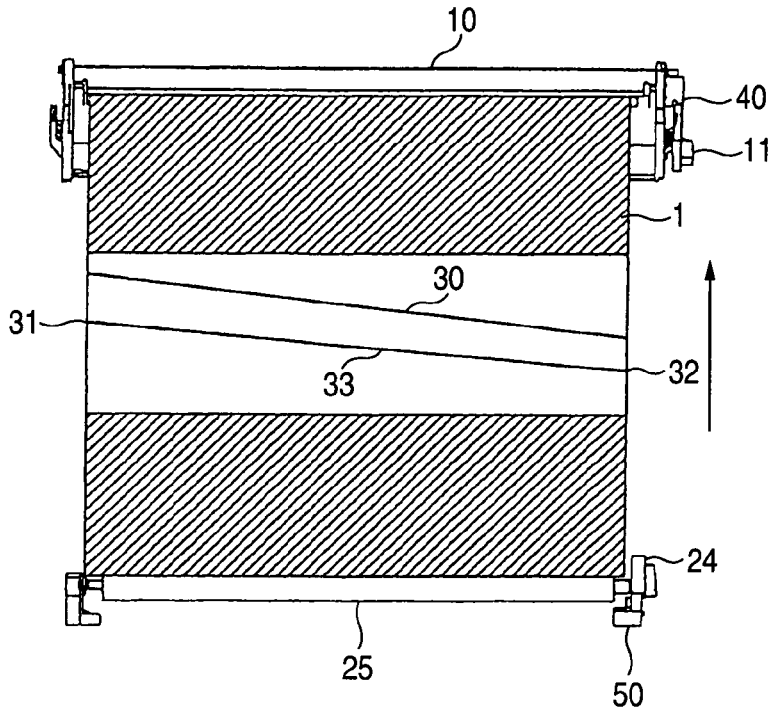
FIG. 18 is a schematic view showing an intermediate transfer unit according to a sixth embodiment of the invention.

FIG. 18 shows a sixth embodiment of the invention. Elements similar to those in the above embodiments are designated by the same reference numerals and the repetitive explanations for those will be omitted here.

In this embodiment, the intermediate transfer belt is formed with the seam 30 extending obliquely relative to the belt circulating direction as indicated by an arrow. The cleaning blade 10 is provided with brackets 40, 46 at both ends of a support shaft thereof, and the bracket 40 is engaged with a cam 11 serving as the switching mechanism. The cleaning blade 10 is brought into contact with the intermediate transfer member firstly from a side opposed to a side formed with the cam 11.

A region including the seam 30 is a non-image forming region and the other region (hatched region) is an image forming region. In this embodiment, the cleaning blade 10 is brought into contact with an end portion 31 in the non-image forming region, and the contacting operation is finished at an opposed side end portion 32 to form a contact track 33. Since the position of the seam 30 is known, the switching mechanism 11 is controlled by a controller (not shown, but may be the controller 70 shown in FIG. 13) such that the contact track 33 avoids the seam 30. Thereby, vibration due to the contact of the cleaning blade and the seam can be avoided.

The cleaning blade is separated therefrom at a predetermined timing at which when the non-image forming region comes again after the one circulation of the intermediate transfer belt 1. The side of the cleaning blade 10 which is firstly brought into contact with belt 1 is lastly separated as in the above described embodiments. Here, adequately controlling the timing of contacting and separating the cleaning blade 10 in connection with the non-image forming region, it is possible to separate the cleaning blade 10 from the belt 1 such that there is not any contact between the cleaning blade 10 and the seam 30.

In this embodiment, the secondary transfer roller 25 is also provided with brackets 50, 56 at both ends thereof, and the bracket 50 is engaged with a cam 24 serving as the switching mechanism. Operating the secondary transfer roller 25 through the cam 24 in the same way as described in connection with the cleaning blade 10, the same advantages can be obtained also in the secondary transfer position.

Figure 19:
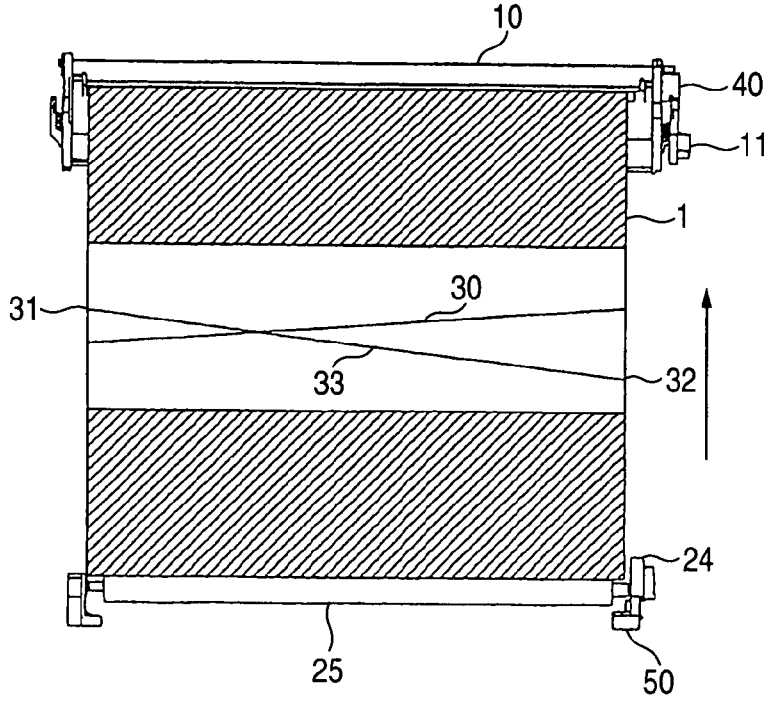
FIG. 19 is a schematic view showing an intermediate transfer unit according to a seventh embodiment of the invention.

FIG. 19 shows a seventh embodiment of the invention. Elements similar to those in the above embodiments are designated by the same reference numerals and the repetitive explanations for those will be omitted here.

In this embodiment, the switching mechanism 11 is controlled such that the contact track 33 crosses the seam 30, so that the contact position of the cleaning blade and the seam is gradually shifted. Therefore, impact or vibration due to the contact can be alleviated.

Similarly to the cleaning blade 10, the switching mechanism 24 is controlled such that the secondary transfer roller 25 is brought into contact with the belt 1 at the end portion 31 in the non-image forming region, the contact is finally finished at the opposed side end portion 32 in the non-image forming region to form the contact track 33 crossing the seam 30. The same advantages can be attained also in the secondary transfer position.

Figure 20:
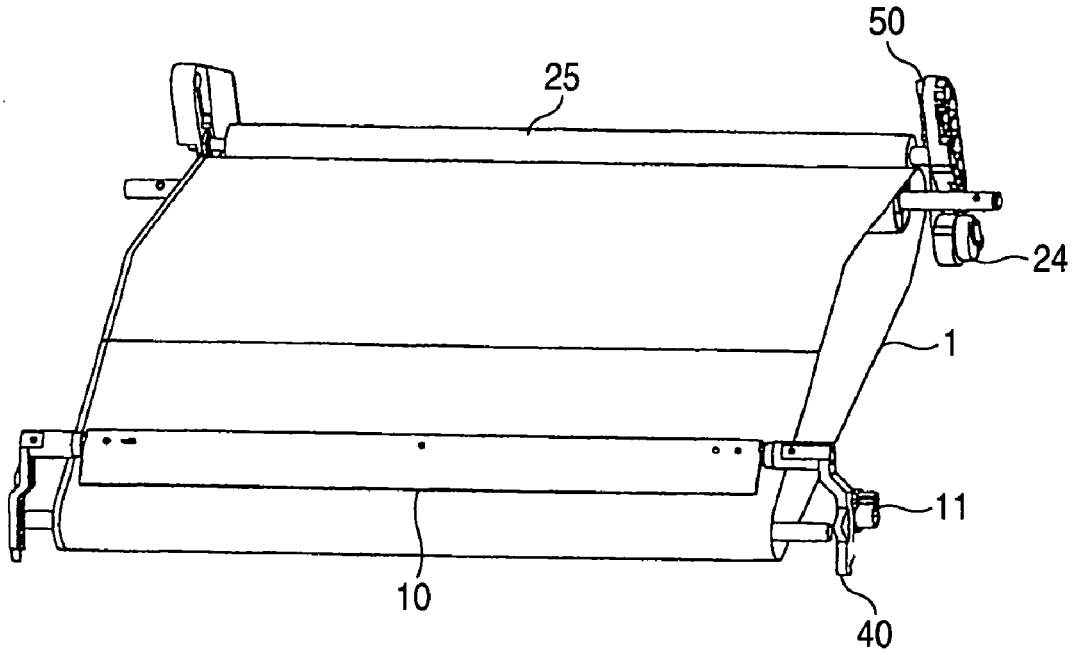
FIG. 20 is a perspective view showing an entire configuration of the intermediate transfer unit applicable to the fourth through seventh embodiments.

FIG. 20 is a perspective view for explaining a positional relationship among the intermediate transfer belt 1, the cleaning blade 10 and the secondary transfer roller 25.

The bracket 40 is engaged with the cam 11 and the bracket 50 is engaged with the cam 24, so that both of the cleaning blade 10 and the secondary transfer roller 25 are respectively brought into contact with the belt 1 firstly from the sides opposed to sides formed with the cams 11, 24.

Figure 21:
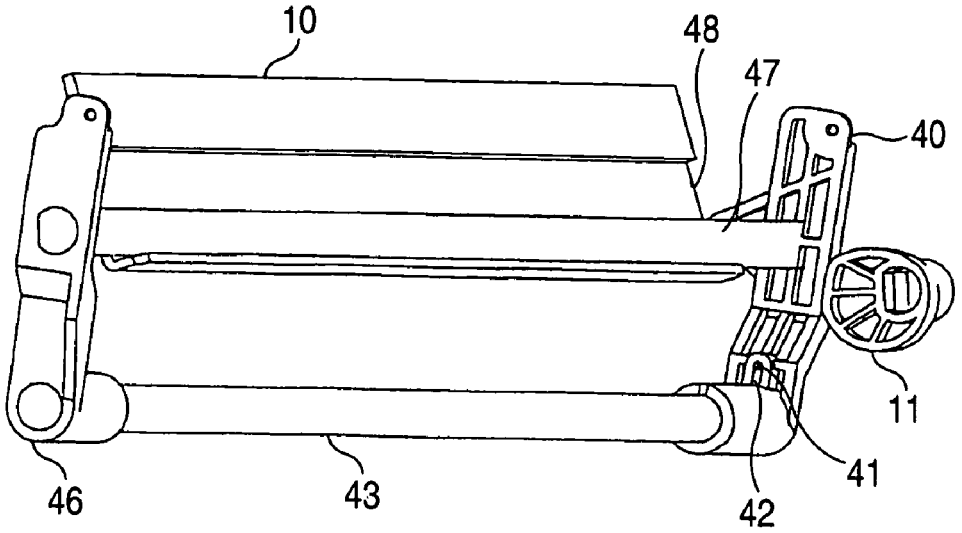
FIGS. 21 and 22 are perspective views showing a cam mechanism for a cleaning blade in the intermediate transfer unit of FIG. 20.
Figure 22:
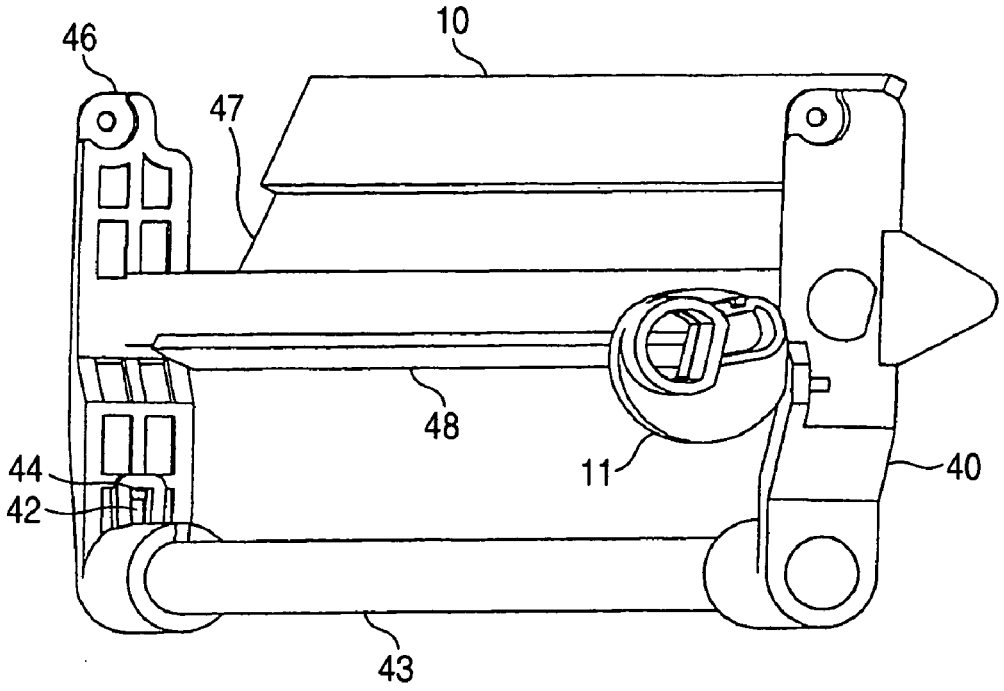

As shown in FIG. 21, the bracket 40 is fitted to one end of a fulcrum shaft 43, and a pin 42 projected from the fulcrum shaft 43 is fitted to a hole 41 formed at an inner side of the bracket 40 without play. Further, the cleaning blade 10 attached to a metal plate 48 is supported by a support plate 47 provided between the brackets 40, 46. As shown in FIG. 22, the bracket 46 is fitted to the other end of the fulcrum shaft 43, and a pin 45 projected from the fulcrum shaft 43 is loosely fitted to a hole 44 formed at an inner side of the bracket 46. The respective brackets 40, 46 are normally urged in a direction of being brought into contact with the intermediate transfer belt 1 by an elastic member (not shown).

In such a structure, when the cam 11 is pivoted, the bracket 40 is pivoted around the fulcrum shaft 43 and at this occasion, since the pin 42 is fitted to the hole 41 without play, the fulcrum shaft 43 is pivoted along therewith. Although the pin 45 at the opposed side is also pivoted by pivoting the fulcrum shaft 43, since there is play between the pin 45 and the hole 44, the bracket 46 is pivoted by being retarded by an amount of the play between the hole 44 and the pin 45. Further, since the respective brackets 40, 46 are urged in the direction of being brought into contact with the intermediate transfer belt by the elastic member, the support plate 47 is pushed by the bracket 46 on the side opposed to the cam 11 by the amount of play, so that the end portion of the cleaning blade 10 on the side of the bracket 46 is firstly brought into contact with the belt 1. At this occasion, torsion is produced at the support plate 47 by the amount of play so that the end portion of the cleaning blade 10 on the side of the cam 11 is finally brought into contact with the belt 1.

At the separating operation, the bracket 40 is firstly separated from the belt 1 by the cam mechanism, and the side of the bracket 46 is separated retardedly by the amount of play, so that also the cleaning blade 10 follows the movement. According to such a constitution, since the switching mechanism is constituted only by the single cam, a reduction in cost can be achieved.

Figure 23:
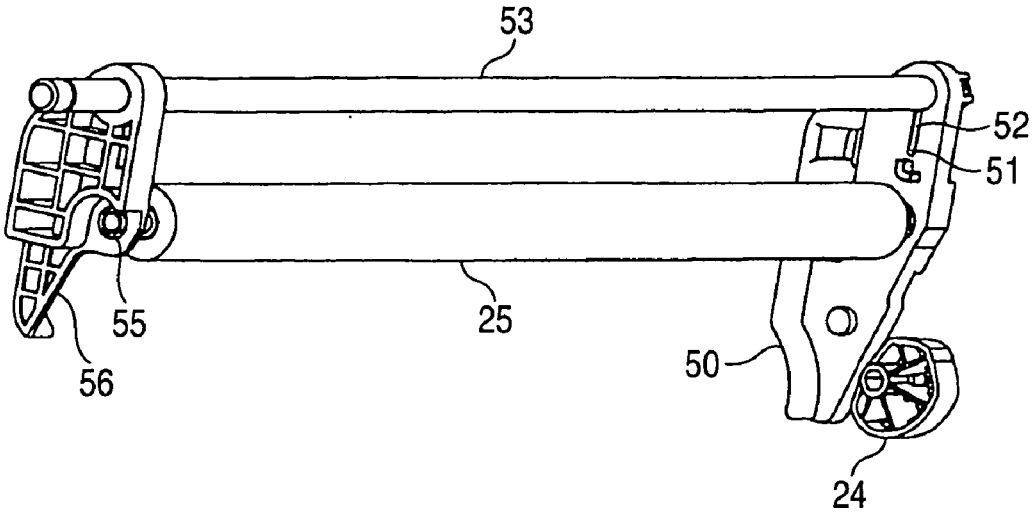
FIGS. 23 through 24B are perspective views showing a cam mechanism for a secondary transfer roller in the intermediate transfer unit of FIG. 20.
Figure 24A:
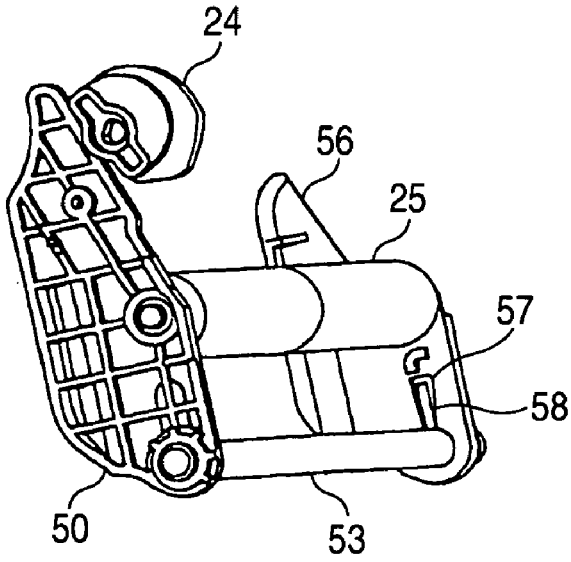
Figure 24B:
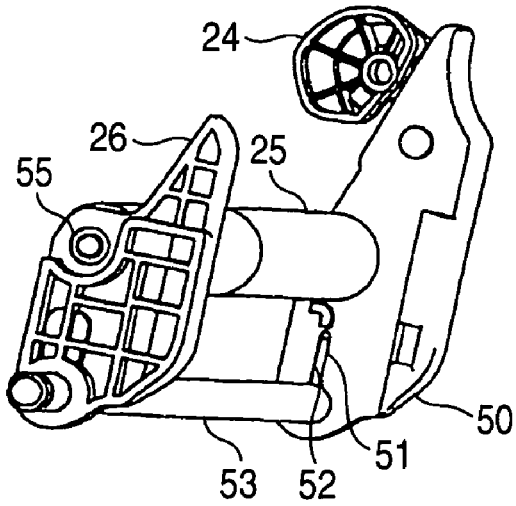

As shown in FIG. 23, a roller shaft 55 of the secondary transfer roller 25 is supported by the brackets 50, 56 at the both end portions. As shown in FIG. 24B, the bracket 50 is loosely fitted to one end of a fulcrum shaft 53, and a pin 52 projected from the fulcrum shaft 53 is fitted to a hole 51 formed at an inner side of the bracket 50 without play. As shown in FIG. 24A, the bracket 56 is fitted to the other end of the fulcrum shaft 53, and a pin 58 projected from the fulcrum shaft 53 is loosely fitted to a hole 57 formed at an inner side of the bracket 56. The respective brackets 50, 56 are normally urged in a direction of being brought into contact with the intermediate transfer belt 1 by an elastic member (not shown).

In such a structure, when the cam 24 is pivoted, the bracket 50 is pivoted around the fulcrum shaft 53 and at this occasion, since the pin 52 is fitted to the hole 51 without play, the fulcrum shaft 53 is pivoted along therewith. Although the pin 58 at the opposed side is also pivoted by pivoting the fulcrum shaft 53, since there is play between the pin 58 and the hole 57, the bracket 56 is pivoted by being retarded by an amount of the play between the hole 57 and the pin 58. Further, since the respective brackets 50, 56 are urged in the direction of being brought into contact with the intermediate transfer belt 1 by the elastic member, the secondary transfer roller 25 is pushed by the bracket 56 on the side opposed to the cam 24 by the amount of play, so that the end portion of the secondary transfer roller 25 on the side of the bracket 56 is firstly brought into contact with the belt 1. At this occasion, torsion is produced at the roller shaft 55 by the amount of play so that the end portion of the secondary transfer roller 25 on the side of the cam 24 is finally brought into contact with the belt 1.

At the separating operation, the bracket 50 is firstly separated from the belt 1 by the cam mechanism, and the side of the bracket 56 is separated retardedly by the amount of play, so that also the secondary transfer roller 25 follows the movement. According to such a constitution, since the switching mechanism is constituted only by the single cam, a reduction in cost can be achieved.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An image forming apparatus, comprising:

a belt member, seamed to form an endless belt which is stretched by a plurality of roller members and circulated in a first direction, the belt member provided with an electrode portion at a first end portion thereof in a second direction perpendicular to the first direction; and a cleaning member, abutted against the belt member, wherein:

a seam of the belt member has a first end and a second end, the seam extending obliquely relative to the first direction such that the first end of the seam confronts the electrode portion and is situated upstream from the second end of the seam, the belt member comprises a substrate, a conductive layer laminated on the substrate, and a semiconductive layer laminated on the conductive layer so as to have a smaller dimension than the conductive layer in the second direction; and the electrode portion is formed on both of the conductive layer and the semiconductive layer.

2. An image forming apparatus, comprising:

a belt member, seamed to form an endless belt which is stretched by a plurality of roller members and circulated in a first direction, the belt member provided with an electrode portion at a first end portion thereof in a second direction perpendicular to the first direction; and a cleaning member, abutted against the belt member, wherein a seam of the belt member has a first end and a second end, the seam extending obliquely relative to the first direction such that the first end of the seam confronts the electrode portion and is situated upstream from the second end of the seam, and the image forming apparatus further comprising an electrode roller abutted against the electrode portion to apply a bias voltage for primarily transferring a toner image on the belt member.

3. The image forming apparatus as set forth in claim 2, further comprising a sensor, which monitors the bias voltage to detect a breakage of the seam.

4. An image forming apparatus, comprising:

a belt member, seamed to form an endless belt which is stretched by a plurality of roller members and circulated in a first direction, the belt member provided with an electrode portion at a first end portion thereof in a second direction perpendicular to the first direction; and a cleaning member, abutted against the belt member, wherein:

a seam of the belt member has a first end and a second end, the seam extending obliquely relative to the first direction such that the first end of the seam confronts the electrode portion and is situated downstream from the second end of the seam, the belt member comprises a substrate, a conductive layer laminated on the substrate, and a semiconductive layer laminated on the conductive layer so as to have a smaller dimension than the conductive layer in the second direction; and the electrode portion is formed on both of the conductive layer and the semiconductive layer.

5. An image forming apparatus, comprising:

a belt member, seamed to form an endless belt which is stretched by a plurality of roller members and circulated in a first direction, the belt member provided with an electrode portion at a first end portion thereof in a second direction perpendicular to the first direction; and a cleaning member, abutted against the belt member, wherein a seam of the belt member has a first end and a second end, the seam extending obliquely relative to the first direction such that the first end of the seam confronts the electrode portion and is situated downstream from the second end of the seam, and the image forming apparatus further comprising an electrode roller abutted against the electrode portion to apply a bias voltage for primarily transferring a toner image on the belt member.

* * * * *